US010269270B2

(12) United States Patent
Coley et al.

(10) Patent No.: US 10,269,270 B2
(45) Date of Patent: Apr. 23, 2019

(54) POSTER HANDLE

(71) Applicants: Ann Coley, New York, NY (US); Stuart Harvey Lee, Forest Hills, NY (US); Jenna Marie Edgemon, Brooklyn, NY (US)

(72) Inventors: Ann Coley, New York, NY (US); Stuart Harvey Lee, Forest Hills, NY (US); Jenna Marie Edgemon, Brooklyn, NY (US)

(73) Assignee: COLEY CREATIVE LLC, New York, NY (US)

( * ) Notice: Subject to any disclaimer, the term of this patent is extended or adjusted under 35 U.S.C. 154(b) by 539 days.

(21) Appl. No.: 14/060,660

(22) Filed: Oct. 23, 2013

(65) Prior Publication Data

US 2015/0107056 A1 Apr. 23, 2015

(51) Int. Cl.
*G09F 1/10* (2006.01)
*G09F 15/02* (2006.01)

(52) U.S. Cl.
CPC ..... *G09F 1/10* (2013.01); *G09F 15/025* (2013.01); *Y10T 16/44* (2015.01); *Y10T 16/469* (2015.01); *Y10T 16/473* (2015.01)

(58) Field of Classification Search
USPC ..... 40/124.14, 539, 586, 594, 603, 606.01, 40/661.12; 248/444, 459; 493/909, 952, 493/955
See application file for complete search history.

(56) References Cited

U.S. PATENT DOCUMENTS

| | | | | | |
|---|---|---|---|---|---|
| 897,332 | A * | 9/1908 | Wilson | 402/74 | |
| 1,846,988 | A * | 2/1932 | Buck | 40/603 | |
| 2,376,180 | A * | 5/1945 | Paige | 40/764 | |
| 2,630,641 | A * | 3/1953 | Hessdoerfer | 40/603 | |
| 2,641,403 | A * | 6/1953 | Buttery | B65D 3/28 229/402 | |
| 2,775,382 | A * | 12/1956 | Kayat | 229/402 | |
| 2,939,237 | A * | 6/1960 | Stein | 40/311 | |
| 3,601,916 | A * | 8/1971 | Epstein | 40/605 | |
| 4,426,800 | A * | 1/1984 | Brown | 40/612 | |
| 4,876,811 | A * | 10/1989 | Peltz | 40/586 | |
| 4,965,946 | A * | 10/1990 | Hegedus et al. | 40/124.4 | |
| 5,037,136 | A * | 8/1991 | McIntire | 281/15.1 | |
| 5,090,143 | A * | 2/1992 | Schier et al. | 40/790 | |
| 5,337,947 | A * | 8/1994 | Eskandry | 229/115 | |
| 5,551,177 | A * | 9/1996 | Cowgill et al. | 40/610 | |
| 5,647,624 | A * | 7/1997 | Beshara, Jr. | 294/27.1 | |
| 5,694,711 | A * | 12/1997 | Cowgill et al. | 40/610 | |
| 5,960,848 | A * | 10/1999 | Schirer | 160/135 | |
| 6,003,256 | A * | 12/1999 | Leach et al. | 40/610 | |
| 7,293,380 | B2 * | 11/2007 | Repecki | 40/124.12 | |
| 7,946,067 | B2 * | 5/2011 | Lambert | 40/754 | |
| 7,966,757 | B2 * | 6/2011 | Hyung-Chul | 40/603 | |

(Continued)

*Primary Examiner* — Kristina N Junge
*Assistant Examiner* — Christopher E Veraa
(74) *Attorney, Agent, or Firm* — Florek & Endres PLLC

(57) ABSTRACT

A poster handle including one or more support members, each support member having a support body with one or more support extensions and one or more securing elements on at least a portion of an attachment side of the support member, and a handle member including an attachment section, one or more gripping sections and one or more securing elements on an attachment side of the attachment section.

12 Claims, 4 Drawing Sheets

(56) References Cited

U.S. PATENT DOCUMENTS

| | | | | |
|---|---|---|---|---|
| 2003/0051381 | A1* | 3/2003 | Hernandez | G09F 1/10 40/586 |
| 2004/0003523 | A1* | 1/2004 | Spencer | 40/452 |
| 2005/0198875 | A1* | 9/2005 | Herrin | 40/124.13 |
| 2010/0287803 | A1* | 11/2010 | Longobardo | 40/606.01 |
| 2013/0014411 | A1* | 1/2013 | Garcia | D06C 3/08 38/102.1 |

* cited by examiner

POSTER HANDLE

FIELD OF THE INVENTION

The present invention relates to a poster handle that is adhered to a poster, permitting a user to hold the poster with one hand.

BACKGROUND OF THE INVENTION

Other than being hung on a wall, posters are often brought to sporting events, gatherings, demonstrations, graduations, celebrations and the like to provide a visual message to participants or other attendees. Posters are also used on street corners to alert potential customers to sales, promotions or the location of an establishment.

Since such posters are generally intended to be seen by many and at a distance, they tend to be large, often in the range of 16×20 inches to 24×36 inches or larger. Moreover, since the poster is generally intended to be clearly seen without curling or folding on itself, it is often mounted on a backing material such as a cardboard or foam board backing.

When posters are being held by a user, rather than being hung on a wall or other structure, the user has to hold the poster up to display it. Due to the generally large size, however, this requires that the user hold the poster with two hands. Using two hands to hold a poster limits what the user can otherwise hold as well as limiting the movement of the poster if the user seeks to waive the poster to gain attention.

Accordingly, a need exists for an improved device to hold a poster which can be secured to a poster or a poster backing and allow the user to hold the poster easily and comfortably with just one hand.

SUMMARY OF THE INVENTION

The present invention is directed generally to a poster handle comprising one or more support members, each support member comprising a support body with one or more support extensions and one or more securing elements on at least a portion of an attachment side of the support member, and a handle member comprising an attachment section, one or more gripping sections and one or more securing elements on an attachment side of the attachment section.

Preferably, the handle member is capable of being adapted from a storage configuration, where the handle member may be stored flat prior to securing to the back of the poster or between uses, to a use configuration, where the one or more gripping sections are configured to extend outward from the back of the poster for the user to more easily engage the gripping sections.

In its preferred embodiment, the one or more support members comprise two or more support extensions projecting from a support body with adhesive on the attachment side of each of the support body and support extensions. The support body can be secured to the poster in a central area of the poster with the support extensions secured to the poster projecting toward the periphery of the poster, and preferably toward the corners of the poster.

Most preferably for ease of packaging and storage of the device prior to use, the present invention utilizes two support members, each having a support body and two support extensions projecting from said support body at diverging angles. In this embodiment, the support bodies of the two support members are placed "back to back" with the handle member therebetween in the central area of the poster. This arrangement permits the support extensions to project in different directions at angles of about 20-180° to each other, and preferably about 30-40° to each other, preferably toward four corners of the poster.

The handle member is preferably formed of three sections, including an attachment section with the securing element on at least a portion of the attachment side of the attachment member and two gripping sections. In its most preferred embodiment, the gripping sections of the handle member can be folded along score lines delineating the attachment section and the gripping sections. In this way, the handle member can be folded along the score lines to adapt the handle member from a flat, storage configuration to a raised, use configuration.

In the most preferred embodiment, the gripping portions of the handle member preferably include releasably interlocking features on connection elements to maintain the gripping portions of the handle member in the use configuration. The connection elements are preferably formed elements on opposed gripping portions with cooperating interlocking features on the opposed gripping portions.

Most preferably, the handle section is secured to the poster between two support members by securing the attachment side of the attachment portion of the handle member to the poster and then securing the attachment sides of the support members on opposite sides of the handle member. Alternatively, the handle member can be secured to the support members, and preferably the support bodies of the support members, rather than the poster. However, attachment of the handle member to the support members is only a matter of user choice.

The one or more support members and handle member are all preferably formed of a card stock material with improved structural integrity. A preferred card stock material may be a Kraft material with a backing or coating on one or both sides having a thickness of from about 1.0 to about 10.0 mm, with about 1.6 mm being preferred. Of course, any suitable substitute material may be used for the one or more support members and the handle member, including coated papers, plastic sheet material, etc.

The securing element for use on the attachment side of the one or more support members and/or the handle member can be any suitable material or device to secure the one or more support members and the handle member to the poster. These may include adhesives, tapes, clips, snaps, staples hook and loop fasteners, etc., with adhesives, including high tack double sided tapes, being most preferred.

When an adhesive or tape is used as the securing element, it is preferably maintained on the support member and/or attachment portion of the handle member with a releasable covering strip so that the adhesive can be exposed at the time the one or more support members and/or handle member are attached to the poster and/or other components.

It is also anticipated that the one or more support member and/or handle member components of the poster handle of the present invention may be easily folded down into a reduced size, flat package for storage and sale prior to use. Therefore, the component parts, including the support members and handle member may have one or more additional score lines that permit additional folds to maintain the device in a flat, small package for sale or storage.

BRIEF DESCRIPTION OF THE DRAWINGS

The present invention will be better understood when considered in view of the attached drawings, in which like reference characters indicate like parts. The drawings, however, are presented merely to illustrate the preferred embodiment of the invention without limiting the invention in any manner whatsoever.

DETAILED DESCRIPTION OF THE PREFERRED EMBODIMENT

Figure 1:
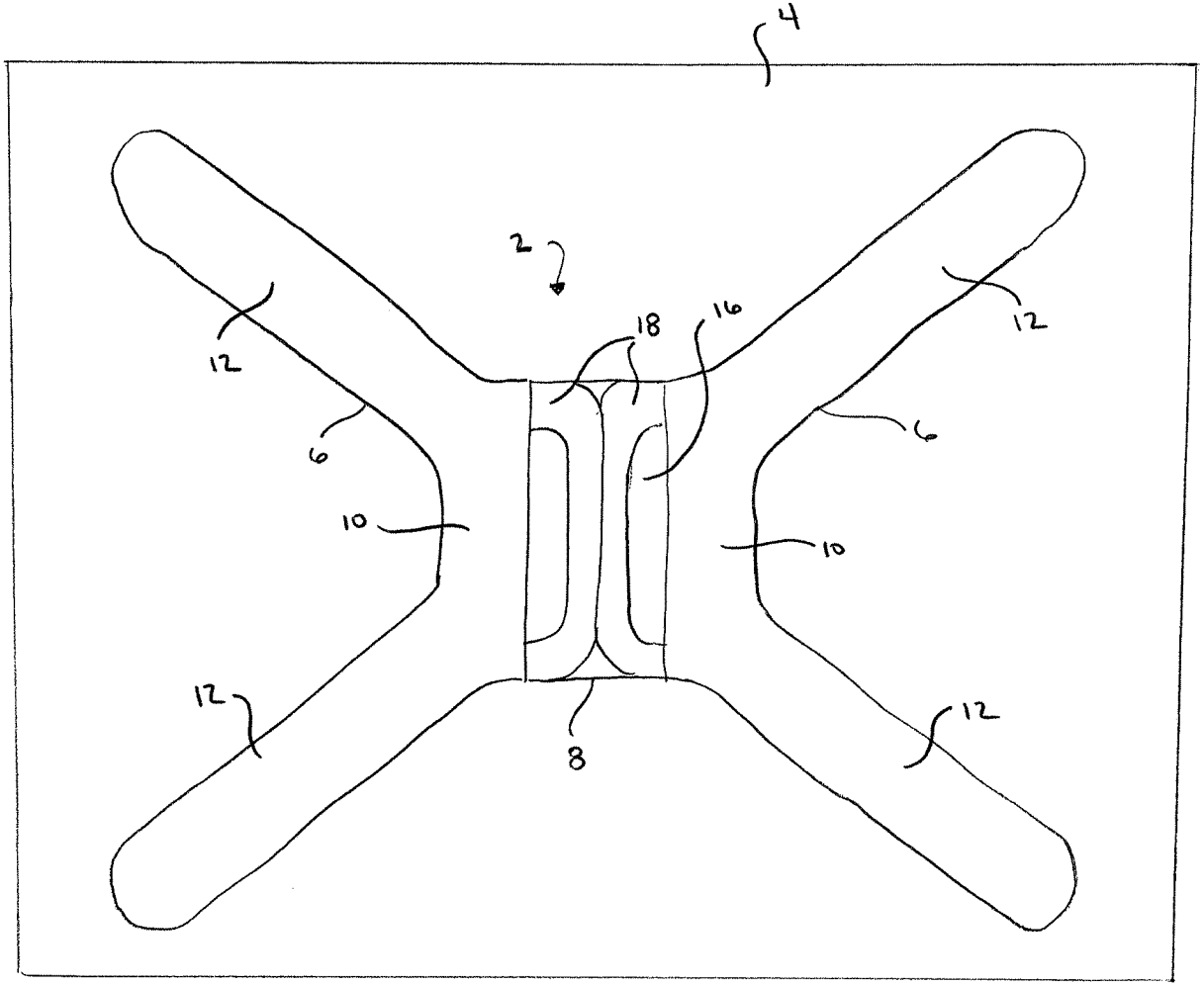
FIG. 1 is a top plan view of the preferred poster handle of the present invention attached to a poster.
Figure 2:
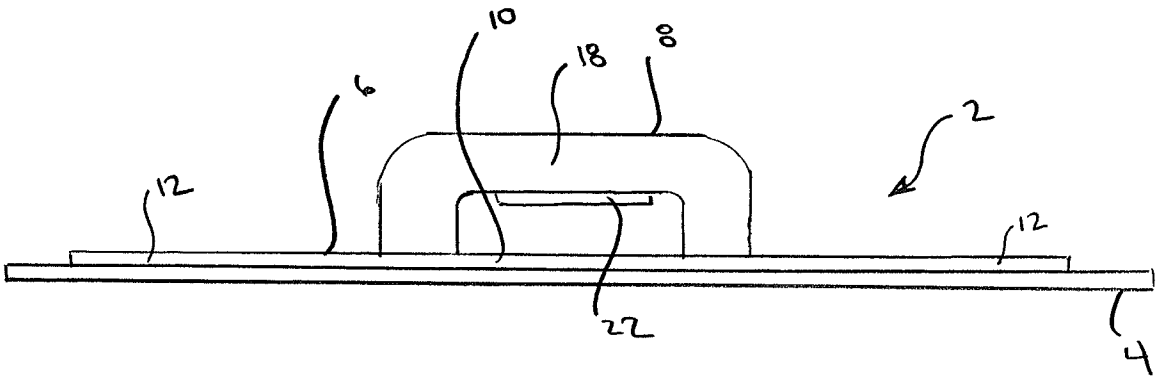
FIG. 2 is a side elevation of the preferred poster handle of the present invention attached to a poster from FIG. 1.
Figure 3:
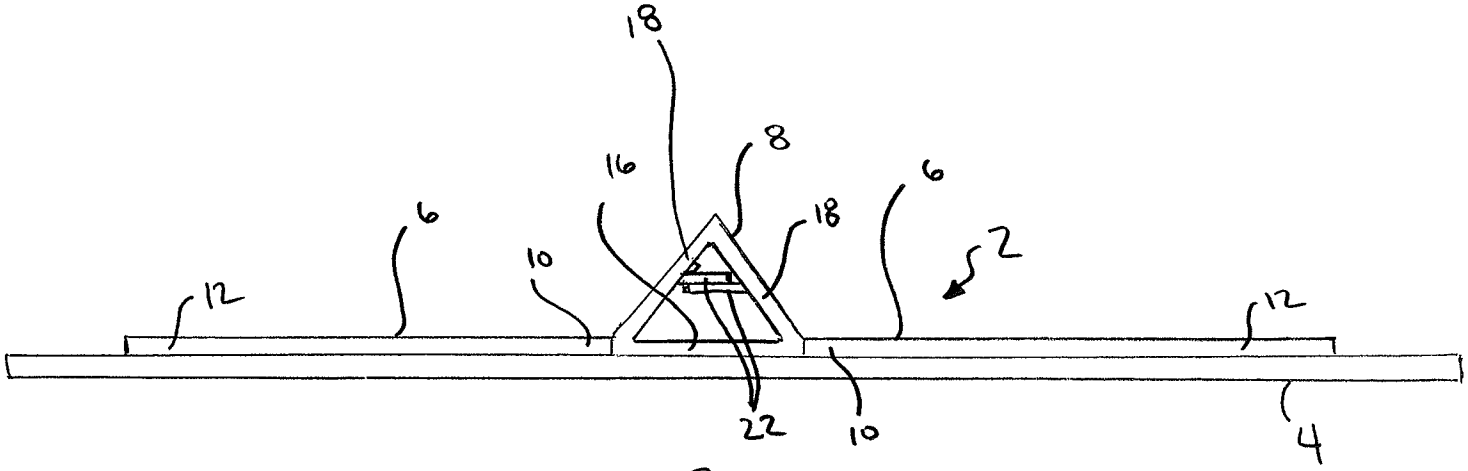
FIG. 3 is a front elevation of the preferred poster handle of the present invention attached to a poster from FIG. 1.

As shown FIGS. 1-3, the present invention comprises a poster handle 2 for attachment to a poster 4 (including the poser backing when used) comprising one or more support members 6 and a handle member 8.

Figure 4B:
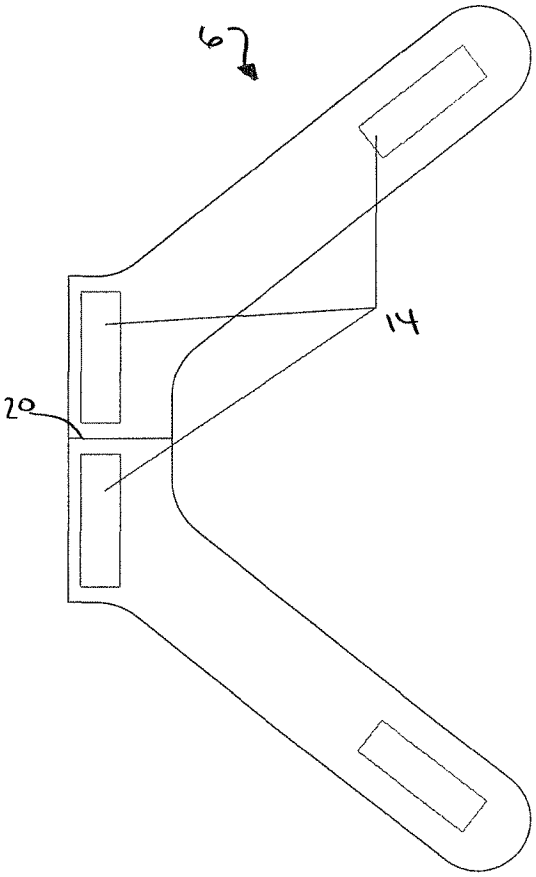
FIG. 4B is a bottom plan view of a preferred support member of the present invention.
Figure 4A:
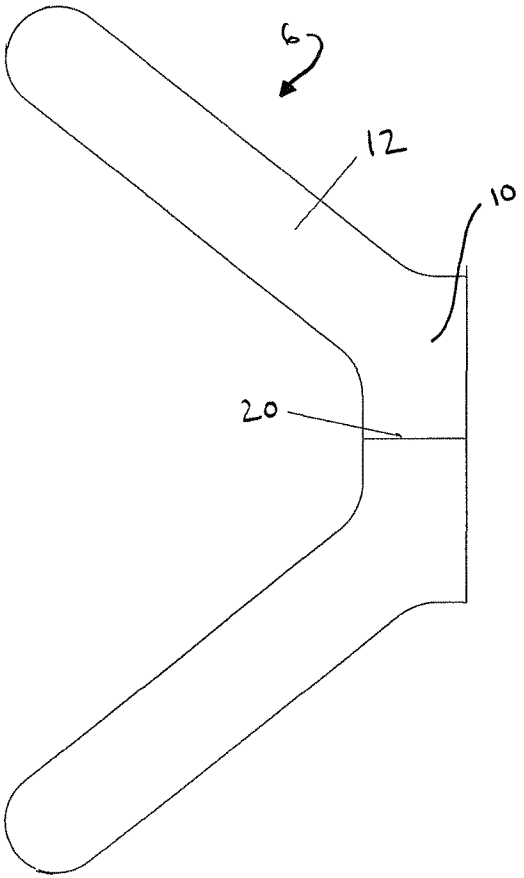
FIG. 4A is a top plan view of a preferred support member of the present invention.

Each support member 6, best shown in FIGS. 4A and B, comprises a support body 10 with two support extensions 12 and one or more securing elements 14 on at least a portion of an attachment side of the support member 6. The handle member 8, best shown in FIGS. 5A and B, comprises an attachment section 16, one or more gripping sections 18 and at least one securing element 14 on an attachment side of the attachment section 16.

In its preferred embodiment shown in FIGS. 1-3, the support members 6 comprise two support extensions 12 projecting from the support body 10 with the securing element 14 on the attachment side of each of the support body 10 and support extensions 12. The support body 10 of each support member 6 is secured to the poster 4 in a central area of the poster 4 with the support extensions 12 secured to the poster 4 projecting toward the periphery of the poster 4 and preferably toward the corners of the poster 4 (see FIG. 1).

Of course, the support member 6 can be formed as a single element, with a central support body 10 and support extensions 12 projecting in two or more opposed directions. For example, such a support member 6 may have a support body 8 in a round or square shape with two sets of support extensions 12 projecting in opposite directions on opposite sides of the support body 8. In such an embodiment, the handle member 8 can be attached to the support body 8 or the support body 8 can have an aperture (not shown) for allowing the handle member 8 to be secured directly to the poster 4.

In the preferred embodiment shown, the handle member 8 is placed between the support members 6 in the central area of the poster 4. This arrangement permits the support extensions 12 to project in diverging directions at angles of about 20-45° to each other, and preferably about 30-40° to each other, toward the four corners of a poster 4 to maximize support.

Of course, the arrangement of the components can be altered or modified. For example, the support members 6 can be secured to the poster 4 with the support bodies 10 adjacent each other and the handle member 8 secured to the support bodies 10 of the support members 6, rather than securing the handle member 8 than directly to the poster 4. Such an arrangement of the components is merely a preference of the user and does not affect the working of the invention.

Figure 5B:
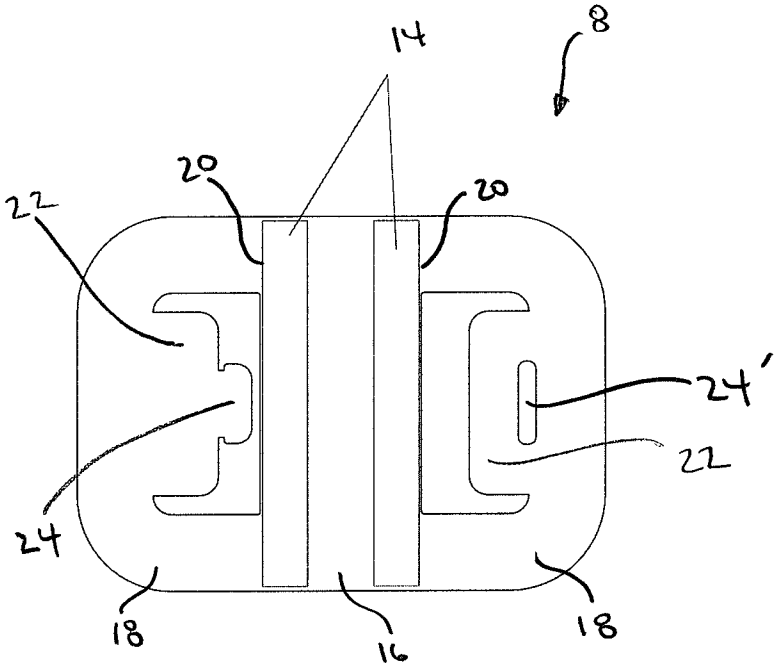
FIG. 5B is a bottom plan view of a preferred handle member of the present invention.
Figure 5A:
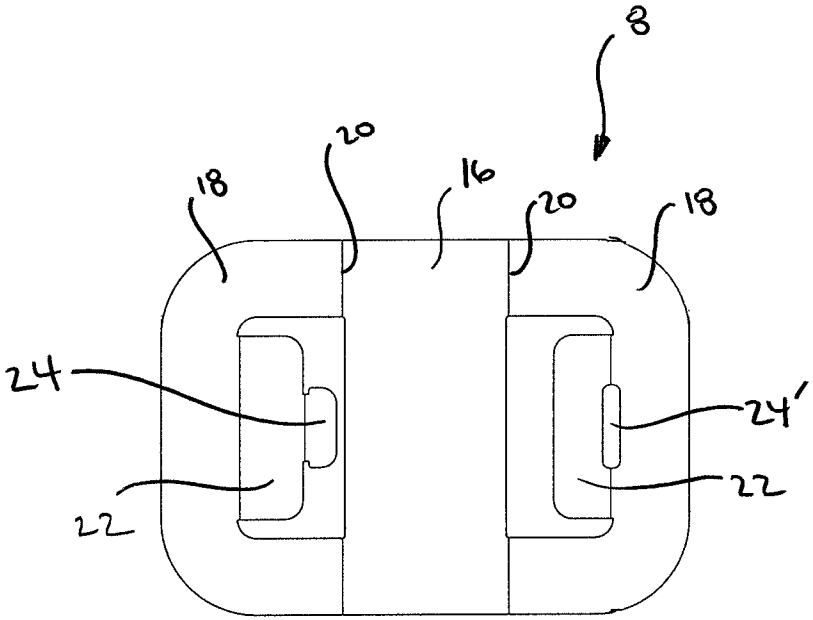
FIG. 5A is a top plan view of a preferred handle member of the present invention.

The handle member 8, best shown in FIGS. 5A and B, is preferably formed of three sections, including an attachment section 16 and two gripping sections 18 on opposed sides of the attachment section 16. The handle member 8 preferably includes score lines 20 with the securing element 14 on at least a portion of the attachment side, and most preferably at least along the score lines 20 on the attachment side, of the attachment section 16. In its most preferred embodiment, the gripping sections 18 of the handle member 8 can be folded along the score lines 20 to adapt the handle member 8 from a flat storage configuration, shown in FIGS. 5A and B, to a raised use configuration, shown in FIGS. 1-3.

In the most preferred embodiment, the gripping portions 18 of the handle member 8 preferably include connection elements 22 with releasably interlocking features 24 to maintain the gripping portions 18 of the handle member 8 in the use configuration shown on FIGS. 1-3. The connection elements 22 are preferably integrally formed on the opposed gripping portions 18 as cooperating elements, with cooperating interlocking features 24 on the opposed connection elements 22.

Although the interlocking features 24 on the connection elements 22 can be any suitable device or structure, including such things as adhesives, tapes, clips, snaps, staples hook and loop fasteners, etc., the preferred embodiment shown uses tab and slot elements. In this embodiment, the tab 24 on a first connection element 22 is inserted into a slot 24' on the cooperating connection element 22. Preferably, the connection elements 22 are releasable elements so that the handle member 8 can be restored to its flat storage configuration if desired.

The one or more support members 6 and handle member 8 are all preferably formed of a card stock material with improved structural integrity. However, as would be understood to one skilled in the art, any suitable material may be used for the one or more support members 6 and the handle member 8, including coated papers, plastic sheet material, etc., as long as it can be secured to and support the poster 4.

For the most preferred embodiment currently envisioned, supporting a 16×20 inch to 24×36 inch poster on a cardboard or foam board backing, it is anticipated that the support member 6 and handle member 8 can be formed of e-flute corrugated cardboard having a thickness of about 1.6 mm. Despite this being the contemplated thickness, it is understood that thicker or thinner materials can be used depending on the application, with thicknesses of from about 1.0 to about 10.0 mm being preferred. Also, it is most preferred that the stock will be a Kraft medium color with white backing on both sides and can also include words or graphics printed thereon.

The securing element 14 for use on the attachment side of the one or more support members 6 and/or the attachment portion 16 of the handle member 8 can be any suitable material or device to secure the one or more support members 6 and/or the handle member 8 to the poster 4. These may include adhesives, tapes, clips, snaps, staples, hook and loop fasteners, etc., with and adhesive, including double sided high tack tape, being most preferred for single use embodiments.

When an adhesive is used as the securing element 14, including a double sided tape, it is preferably maintained with a releasable covering strip as part thereof so that the adhesive can be exposed at the time the one or more support members 6 and handle member 8 are attached to the poster 4 and/or cooperating components.

As will also be apparent to one skilled in the art, the dimensions of the poster handle 2 and component parts can vary depending on the application, i.e., the size and weight of the poster 4 to be supported, etc. In a general use embodiment shown, the support extensions 12 would be about 50 mm wide and extend about 225 mm from the support body 10. The handle member 8 would be about 157 mm high and about 222 mm wide, including the attachment section 16 and both gripping sections 18 when laid flat as shown in FIGS. 5A and B.

Variations, modifications and alterations to the above detailed description will be apparent to those skilled in the art. For example, the handle may be adapted to receive a stick or the like to hold up the poster or more than one poster handle can be secured to a larger sized poster. All such variations, modifications and/or alternatives are intended to fall within the scope of the present invention, limited only by the claims. Any cited patents and/or publications are incorporated by reference.

We claim:

1. A poster handle comprising one or more support members, each support member comprising a support body with one or more support extensions and one or more securing elements on at least a portion of an attachment side of the support member, and a handle member comprising an attachment section, one or more gripping sections for a hand to grip and one or more securing elements on an attachment side of the attachment section, at least one of said one or more gripping sections having a first end coupled to a first end of the attachment section and a second end coupled to a second end of the attachment section forming an elongated opening between said first and second ends adapted to receive a user's hand, the handle member excluding a stand element for resting on a surface to present the poster to which the handle is attached in an upright orientation, wherein at least one of the one or more securing elements of the support member and at least one of the one or more securing elements of the handle member is taken from the group consisting of adhesives, tapes, clips, snaps, staples and hook and loop fasteners.

2. The poster handle of claim 1 wherein the handle member is capable of being adapted from a storage configuration, where the handle member may be stored flat, to a use configuration, where the one or more gripping sections extend outward from the back of a poster for the user to engage the gripping sections.

3. The poster handle of claim 1 wherein the one or more support members comprise two or more support extensions projecting from the support body with at least one securing element on the attachment side of each of the support body and support extensions.

4. The poster handle of claim 3 wherein the support extensions project in divergent directions at angles of 20-180° to each other.

5. The poster handle of claim 4 wherein the support extensions project in divergent directions at angles of 30-40° to each other.

6. The poster handle of claim 1 wherein the handle member comprises two gripping sections attached to opposed lateral sides of the attachment section.

7. The poster handle of claim 6 wherein score lines delineate the attachment section and the gripping sections of the handle member.

8. The poster handle of claim 6 wherein the gripping portions of the handle member preferably include connection elements having releasable interlocking features to maintain the gripping portions of the handle member in a use configuration.

9. The poster handle of claim 1 wherein the one or more support members and the handle member are formed of one or more materials taken from the group consisting of card stock, coated papers and plastic sheet material.

10. The poster handle of claim 1 wherein at least one of the securing element of the support member and the securing element of the handle member is a double sided tape.

11. The poster handle of claim 10 wherein at least one side of the double sided tape is covered by a release strip prior to securing to a poster.

12. A poster handle comprising one or more support members, each support member comprising a support body with one or more support extensions and one or more securing elements on at least a portion of an attachment side of the support member, and a handle member comprising an attachment section, one or more securing elements on a first side of the attachment section taken from the group consisting of adhesives, tapes, clips, snaps, staples and hook and loop fasteners, and two gripping sections extending from opposed lateral sides of the attachment section, with each gripping section having a first end coupled to a first end of the attachment section, a second end coupled to a second end of the attachment section forming an elongated opening between said first and second ends of said gripping section and said attachment section for a hand to grip, and a terminal end opposite the attachment section, the handle member excluding a stand element for resting on a surface to present the poster to which the handle is attached in an upright orientation, wherein the elongated opening is adapted to receive a user's hand, and further wherein the terminal ends of the gripping sections contact each other when in a use configuration.

* * * * *